US012305942B1

(12) United States Patent
Withey

(10) Patent No.: US 12,305,942 B1
(45) Date of Patent: May 20, 2025

(54) MAGAZINE DISCONNECT SAFETY

(71) Applicant: Kimber IP, LLC, Troy, AL (US)

(72) Inventor: Michael Withey, Brundidge, AL (US)

(73) Assignee: Kimber IP, LLC, Troy, AL (US)

( * ) Notice: Subject to any disclaimer, the term of this patent is extended or adjusted under 35 U.S.C. 154(b) by 0 days.

(21) Appl. No.: 18/430,035

(22) Filed: Feb. 1, 2024

(51) Int. Cl.
*F41A 17/36* (2006.01)

(52) U.S. Cl.
CPC ..... *F41A 17/36* (2013.01)

(58) Field of Classification Search
CPC ..... F41A 17/34; F41A 17/36; F41A 17/38
See application file for complete search history.

(56) References Cited

U.S. PATENT DOCUMENTS 984,519 A * 2/1911 Browning ..... F41A 17/38 42/7
1,719,384 A * 7/1929 Tansley ..... F41A 17/36 89/137
2,296,998 A * 9/1942 Koehler ..... F41A 17/36 89/137
2,459,838 A * 1/1949 Quinn ..... F41A 17/36 89/137
2,563,720 A * 8/1951 Guisasola ..... F41A 17/36 42/17
6,240,669 B1 * 6/2001 Spaniel ..... F41A 17/36 42/70.02
6,952,895 B1 * 10/2005 Zonshine ..... F41A 17/36 42/18
9,970,724 B1 * 5/2018 Acker ..... F41A 17/46
10,473,414 B1 11/2019 Curry
12,007,199 B2 * 6/2024 Smathers ..... F41C 23/10
2012/0085010 A1 * 4/2012 Cook ..... F41A 17/36 42/75.02
2024/0035769 A1 * 2/2024 Smathers ..... F41A 19/15

FOREIGN PATENT DOCUMENTS

AT 519769 B1 * 10/2018

* cited by examiner

*Primary Examiner* — Gabriel J. Klein
(74) *Attorney, Agent, or Firm* — Kaplan Breyer Schwarz, LLP

(57) ABSTRACT

A magazine catch safety for a firearm to lock a trigger of a firearm when a magazine is removed from a magazine receptacle of a frame of a firearm, the magazine catch safety having a catch body having a longitudinal axis, an actuating button end, and a spring receiving end, and a protuberance disposed on the catch body. The magazine catch safety further having a securement pin, a spring, and a trigger bow. The trigger bow has a notch, wherein, when the catch body is in a first position, the protuberance is engaged in the notch to prevent movement of the trigger bow, and wherein when the catch body is in a second position, the protuberance of the catch body does not engage the notch, providing for free movement of the trigger bow.

4 Claims, 11 Drawing Sheets

MAGAZINE DISCONNECT SAFETY

BACKGROUND OF THE INVENTION

This invention relates generally to semi-automatic handguns, and, more specifically, to a magazine disconnect safety for a semi-automatic handgun.

Semiautomatic firearms have been manufactured for decades, both in the United States and in many foreign countries. The Model 1911.45 caliber automatic handgun has been an extremely popular autoloading handgun. The Model 1911 pistol is a firearm in which several operations are automatically effected through or by energy of the recoil of the breech bolt or which, at the time of firing, closes the breech of the barrel. These operations include opening the breech after firing a shot, ejection of empty cartridge-shell, cocking of the hammer, presentation and introduction of a loaded cartridge into the chamber of the barrel, and closing and locking of the breech. Additionally, in firing, the barrel and the breech-bolt are interlocked together, and during this rearward movement, the barrel is unlocked from the breech bolt, and subsequently, after the barrel stops moving, the breech bolt continues recoil until the breech is fully opened. During this opening, energy is stored in a spring, the stored energy of which is used to effect the closing movement of the breech bolt.

Safety selection switches and other devices have been integrated into firearms for decades. It has become increasingly important to provide a lockable safety device that prevents a firearm from being discharged even when an operator does not specifically set a safety switch to a safe position.

The Model 1911 pistol, as manufactured by numerous manufacturers, includes a grip lever safety. The Model 1911 pistol is described in U.S. Pat. No. 984,519 which issued to John M. Browning on Feb. 14, 1911. The safety on the 1911 Model pistol prevents the pistol from discharging when the pistol chamber is loaded, ready to fire and the pistol is not properly positioned in the hand of the shooter.

Another category of safeties includes manually activatable and deactivatable safeties using an operator selected lever position. Here, the lever is mounted on the firearm frame in an area where the thumb of the operator is positioned to allow movement by the operator.

It is desirable to provide a safety feature that prevents a chambered cartridge from being discharged when the magazine of the firearm is removed that is simple, inexpensive, and extremely reliable.

All references cited herein are incorporated herein by reference in their entireties.

SUMMARY OF THE INVENTION

In a first exemplary embodiment of the present invention, a magazine catch safety is provided which is directed to a safety device to lock a trigger of a firearm when a magazine is removed from a magazine receptacle of a frame of a firearm. The magazine catch safety includes a catch body, a securement pin, a spring, and a trigger bow having a notch. The catch body includes a longitudinal axis, an actuating button end, and a spring receiving end. The catch body is for receipt in a first side of the frame and disposed for longitudinal movement within the frame. The catch body further includes a protuberance extending out from the spring receiving end. The securement pin has a first end for removable securement on a second side of the frame, and a second spring receiving end. The spring has a first end disposed against the catch body at the spring receiving end of the catch body, and a second end disposed against the second spring receiving end of the securement pin. The trigger bow has a notch, wherein, when the catch body is in a first position, the protuberance is engaged in the notch to prevent movement of the trigger bow. Additionally, when the catch body is in a second position, the protuberance of the catch body does not engage the notch, providing for free movement of the trigger bow.

The magazine catch may include a catch body cam surface and the magazine may include a magazine cam surface, wherein when the magazine is disposed in the magazine receptable in the frame, the magazine cam surface engages the catch body cam surface to move the catch body from the second position to the first position.

In an alternate exemplary embodiment of the present invention, a firearm having a magazine disconnect safety is provided. The firearm includes a frame, a trigger, a magazine, a magazine catch, and a trigger bow. The frame has a magazine receptacle having an open end and a hollow internal portion. The frame further has an aperture adjacent to the magazine receptacle. The trigger is moveable in a plane from an extended position to a depressed position. The magazine is releasably disposed in the magazine receptacle, and is movable from a released position wherein the magazine is separated from the magazine receptacle to an installed position wherein the magazine is seated in the magazine receptacle. The magazine catch is a safety device to lock the trigger when the magazine is removed from the magazine receptacle wherein the magazine catch is disposed in the frame adjacent an upper end of the magazine receptacle. The magazine catch includes a catch body, a securement pin, and a spring. The catch body has a longitudinal axis, an actuating button end, and a spring receiving end. The catch body is captured in a first side of the frame and longitudinally movable within the frame. The catch body further includes a protuberance. The securement pin has a first end removably disposed on a second side of the frame, and a second spring receiving end. The spring has a first end disposed against the catch body at the spring receiving end of the catch body, and a second end disposed against the second spring receiving end of the securement pin. The catch body is movable along its longitudinal axis within the frame from a first position wherein the magazine is disposed in the magazine receptable of the frame to a second position wherein the magazine is separated from the frame. The trigger bow is disposed on the trigger and has a notch. When the catch body is in the first position, the protuberance is engaged in the notch to prevent movement of the trigger bow, and when the catch body is in the second position, the protuberance of the catch body does not engage the notch, providing for free movement of the trigger bow.

The catch body may include a catch body cam surface and the magazine may include a magazine cam surface. When the magazine is disposed in the magazine receptable in the frame, the magazine cam surface engages the catch body cam surface to move the catch body from the second position to the first position.

The magazine disconnect safety described herein is described with specific reference to a Model 1911-type handgun. However, the present invention is intended to have application with many other types and models of handguns and other firearms. No limitation of the scope of the present invention is intended based on the specific reference to the Model 1911 handgun described herein.

DETAILED DESCRIPTION

Figure 1:
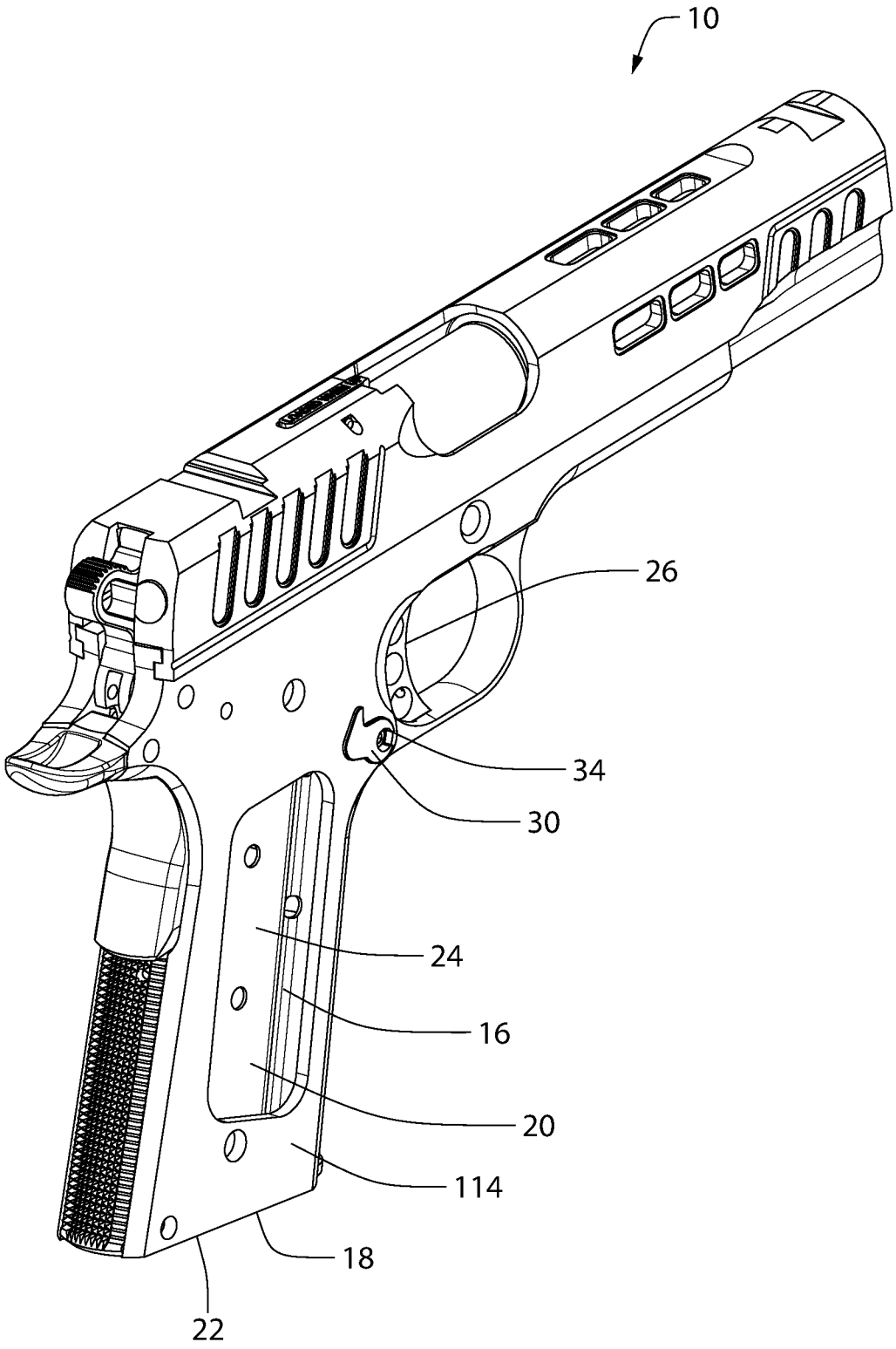
FIG. 1 is an isometric view of a firearm having a magazine disconnect safety in accordance with an exemplary embodiment of the present invention, with certain elements not shown, including grips, safety, etc.
Figure 2:
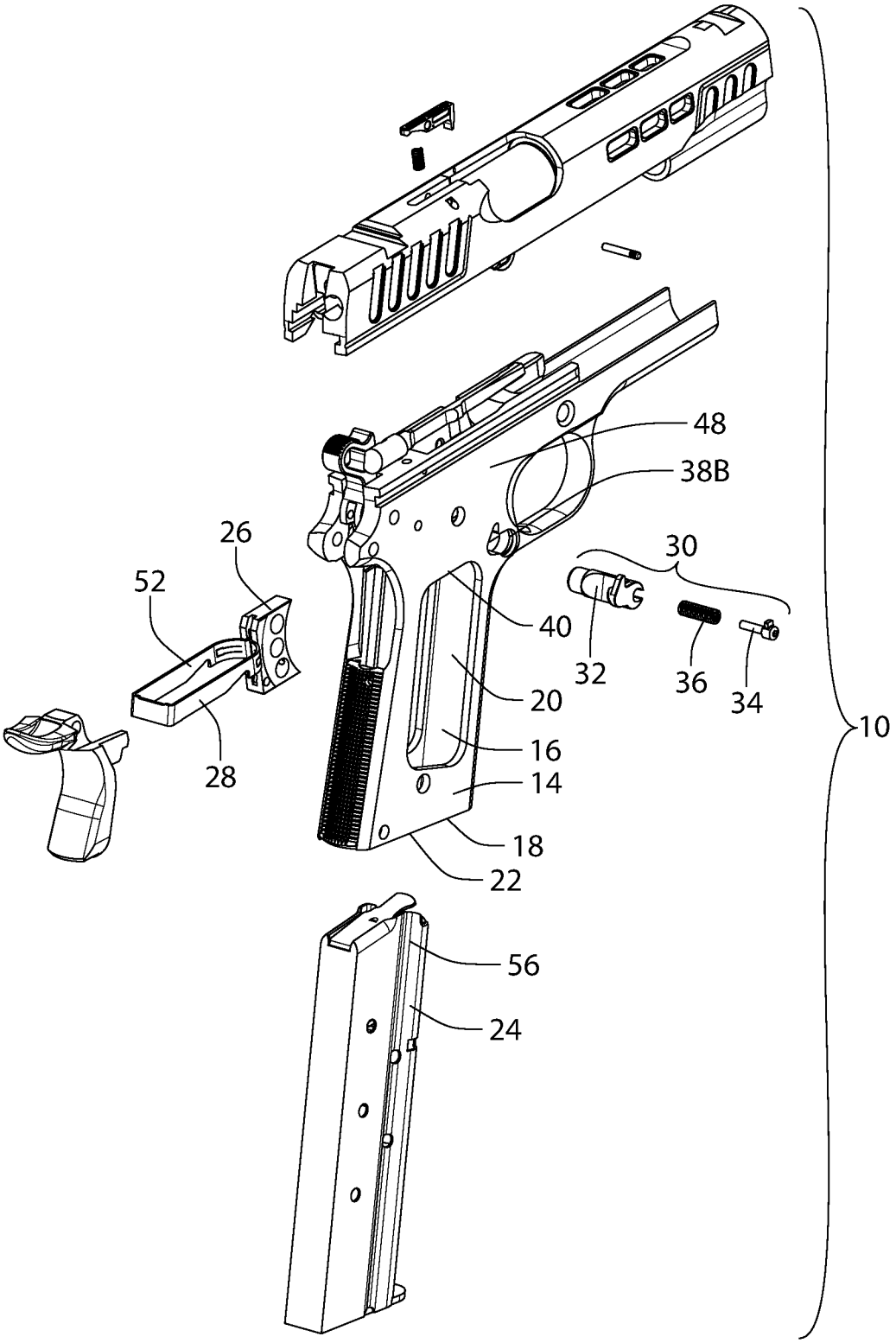
FIG. 2 is an exploded, right, rear isometric view of the firearm having a magazine disconnect safety of FIG. 1.
Figure 3:
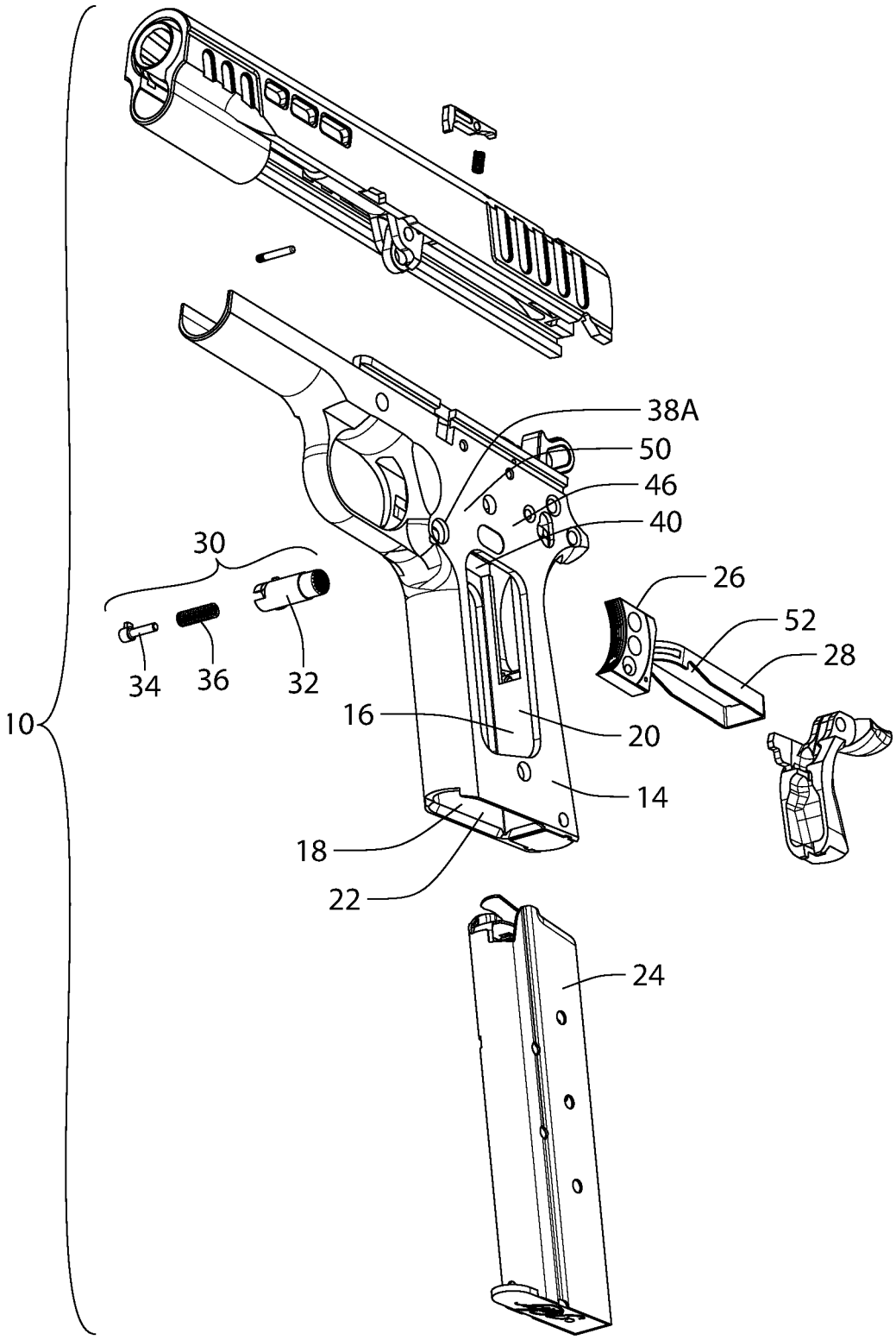
FIG. 3 is an exploded, front left isometric view of the firearm having a magazine disconnect safety of FIG. 1.

Referring now to the drawing figures, wherein like reference numbers refer to like elements throughout the several views, there is shown in FIGS. 1-3 a firearm 10 having a magazine disconnect safety 12 in accordance with an exemplary embodiment of the present invention. The firearm 10 includes a frame 14 having a magazine receptacle 16. The magazine receptacle 16 has an open end 18 and a hollow internal portion 20. The frame has an aperture 22 to receive a magazine 24 adjacent to the magazine receptacle 16. The firearm 10 further includes a trigger 26, a trigger bow 28 and a magazine catch 30.

The trigger 26 is movable in a plane from an extended position to a depressed position, in the typical manner, and as will be discussed below. The trigger bow 28 is disposed on the trigger 26 in the typical manner for semi-automatic firearms such as a 1911 type pistol. The magazine 24 is disposed in the magazine receptacle 16 through the aperture 22, again in the typical manner for many semi-automatic firearms. That is, the magazine 24 is movable from a released position wherein the magazine is separated from the magazine receptacle to an installed position wherein the magazine is seated and secured in the magazine receptacle 16. Again, details of this as related to the present invention are discussed below.

Figure 4A:
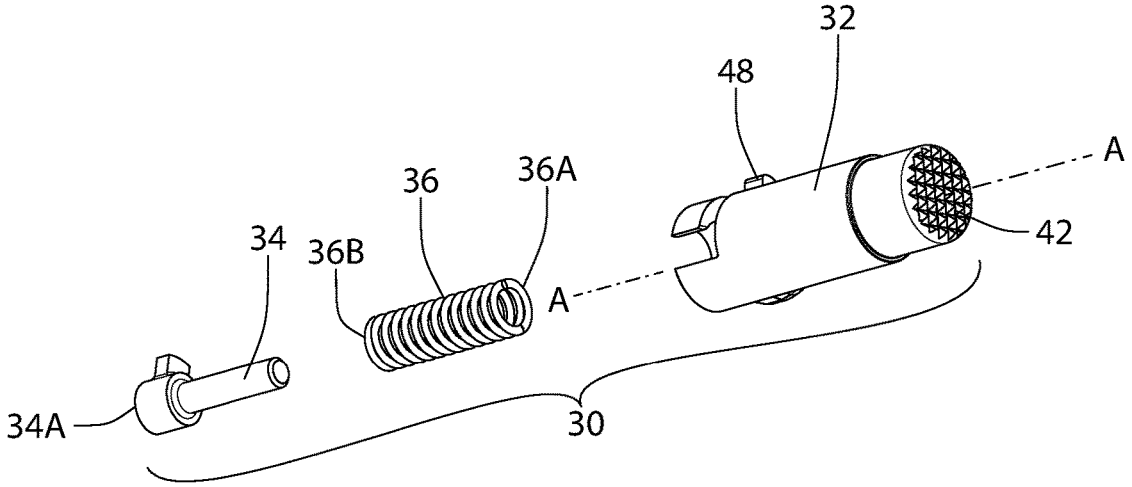
FIG. 4A is an exploded front isometric view of a magazine catch of the firearm having a magazine disconnect safety of FIG. 1.
Figure 4B:
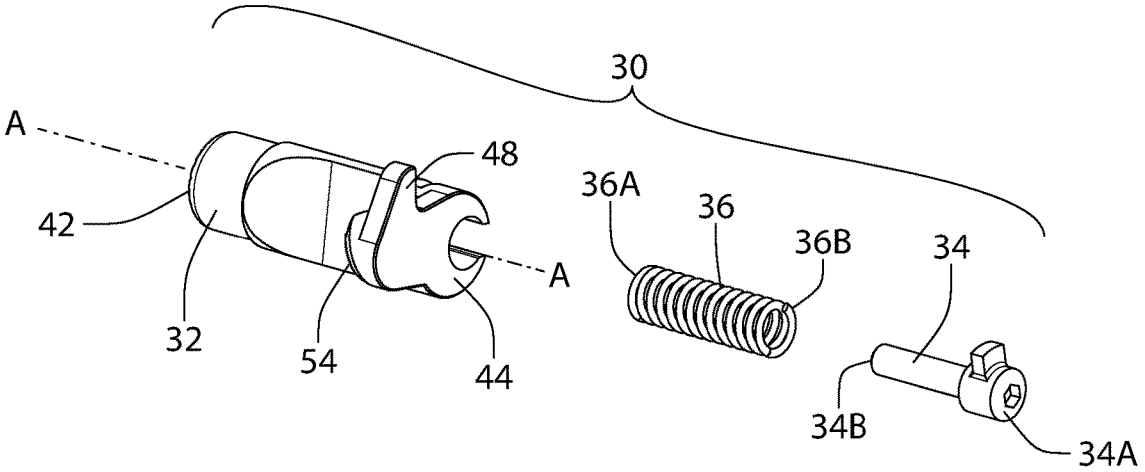
FIG. 4B is an exploded rear isometric view of the magazine catch of FIG. 4A.

The magazine catch 30 is a safety device to prevent the firearm 10 from firing by locking the trigger bar 28 to prevent its movement when an attempt is made to press the trigger 26 when the magazine 24 is not present in the magazine receptable 16 in the frame 14 of the firearm 10. As can be seen in FIGS. 4A and 4B, the magazine catch 30 has three primary components: a catch body 32, a securement pin 34, and a spring 36. The magazine catch 30 is disposed in apertures in the frame 14 behind the trigger 26 and adjacent to an upper end 40 the magazine receptacle 16. In the present exemplary embodiment of the present invention as it applies to a 1911 style semi-automatic pistol, the magazine catch 30 is generally similar to those that presently exist. However, that prior art design is modified in accordance with the present invention to provide the magazine safety disconnect 12 of the present invention.

As best seen in FIGS. 4A and 4B, the catch body 32 includes a longitudinal axis A, an actuating button end 42, and a spring receiving end 44. The catch body 32 is captured in an aperture 38A on a first side 50 of the frame 14 (i.e., by a ledge on the catch body 32 that provides a step-down in diameter; the stepped-down diameter is sized to be captured in the aperture 38A) and is movable longitudinally along axis A within the frame 14. See FIG. 3. A protuberance 48 extends outwardly on the catch body 32, preferably adjacent to the spring receiving end 44.

Figure 6A:
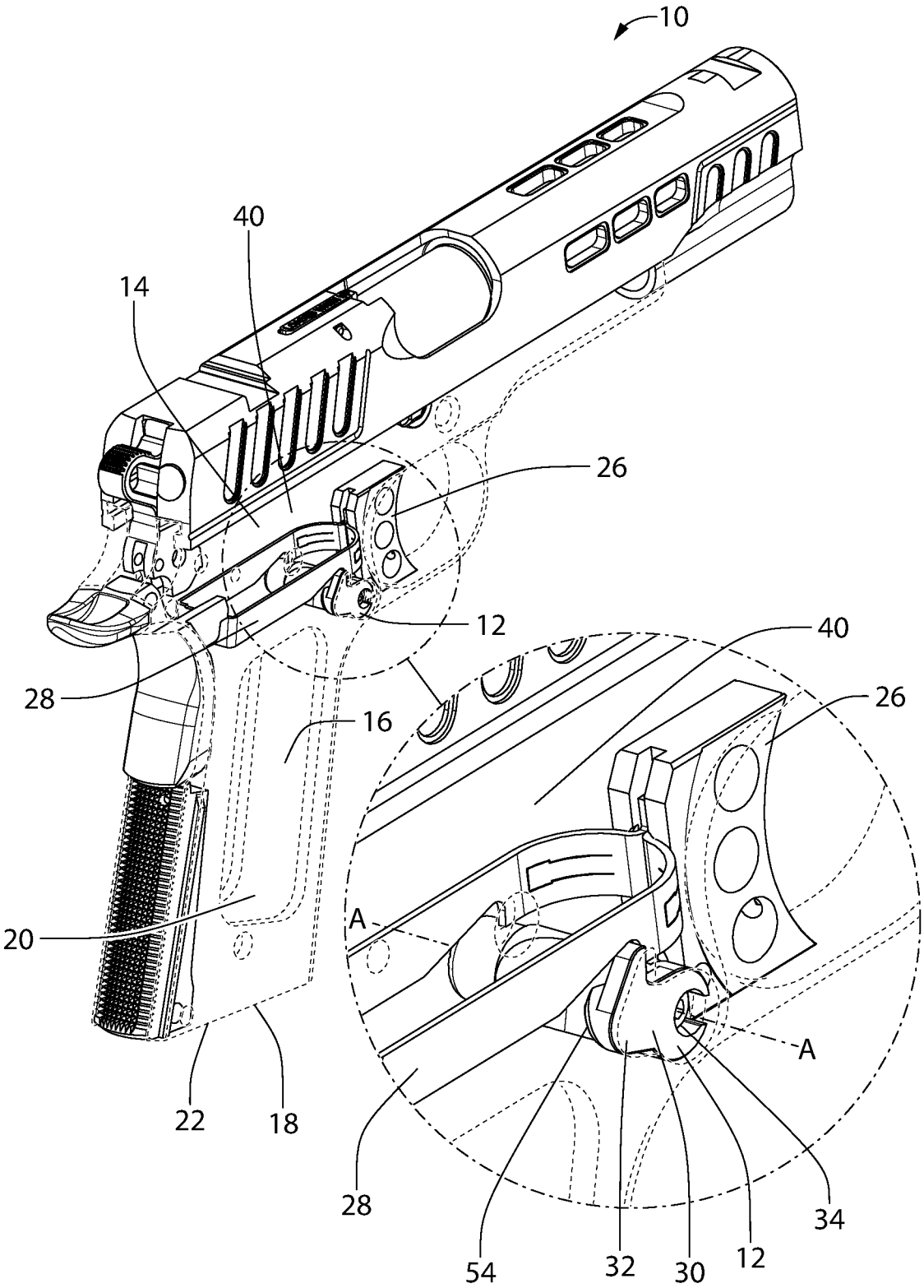
FIG. 6A is a right rear isometric view of the firearm having a magazine disconnect safety of FIG. 1, shown with an enlarged view of a trigger, trigger bar and magazine catch, shown without a magazine in a magazine receptable of the frame of the firearm.
Figure 6B:
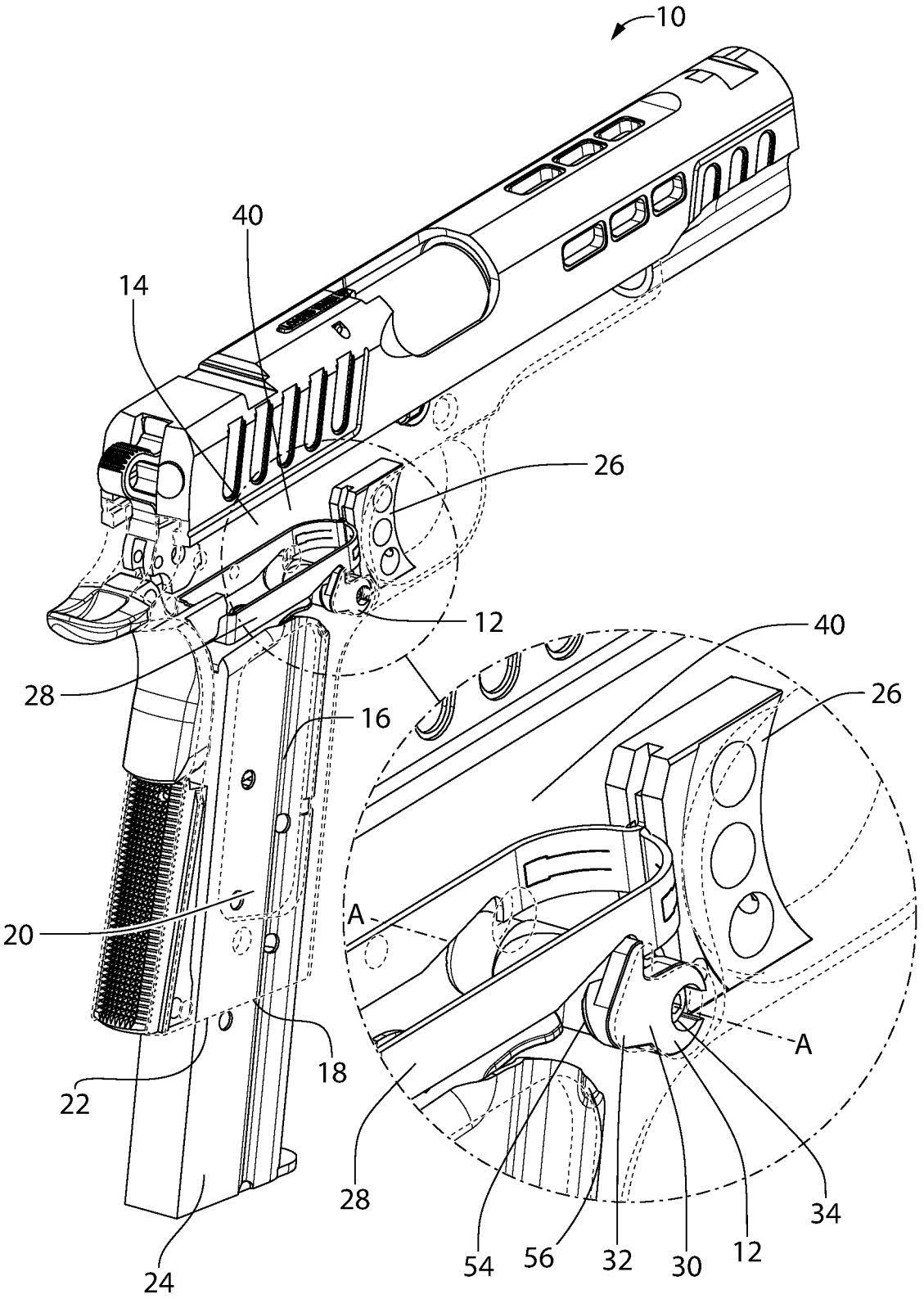
FIG. 6B is a right rear isometric view of the firearm having a magazine disconnect safety of FIG. 1, shown with an enlarged view of a trigger, trigger bar and magazine catch, shown with a magazine partially inserted in a magazine receptable of the frame of the firearm, prior to engagement with the magazine catch.
Figure 6C:
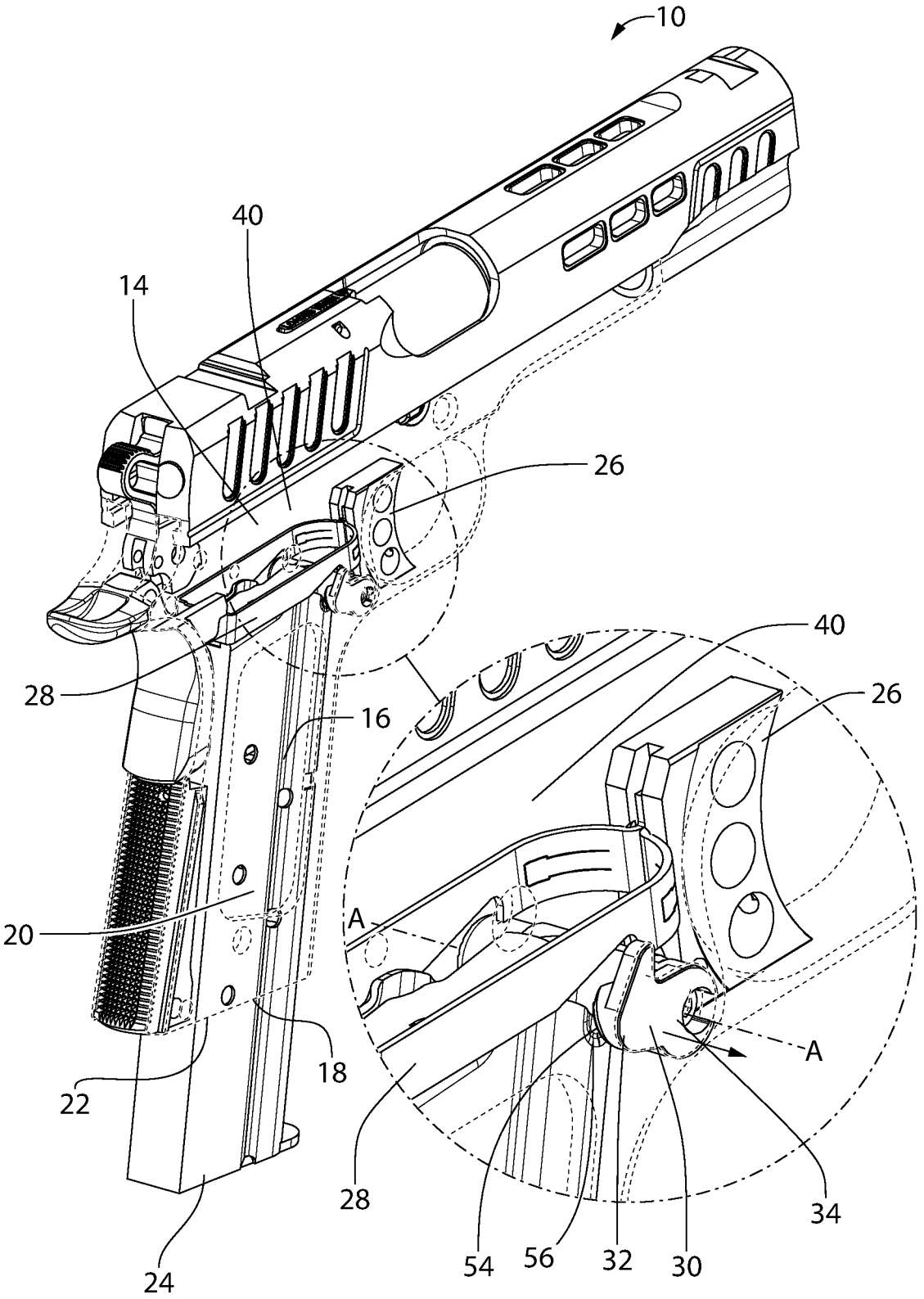
FIG. 6C is a right rear isometric view of the firearm having a magazine disconnect safety of FIG. 1, shown with an enlarged view of a trigger, trigger bar and magazine catch, shown with a magazine partially inserted in a magazine receptable of the frame of the firearm beginning engage the magazine catch.
Figure 6D:
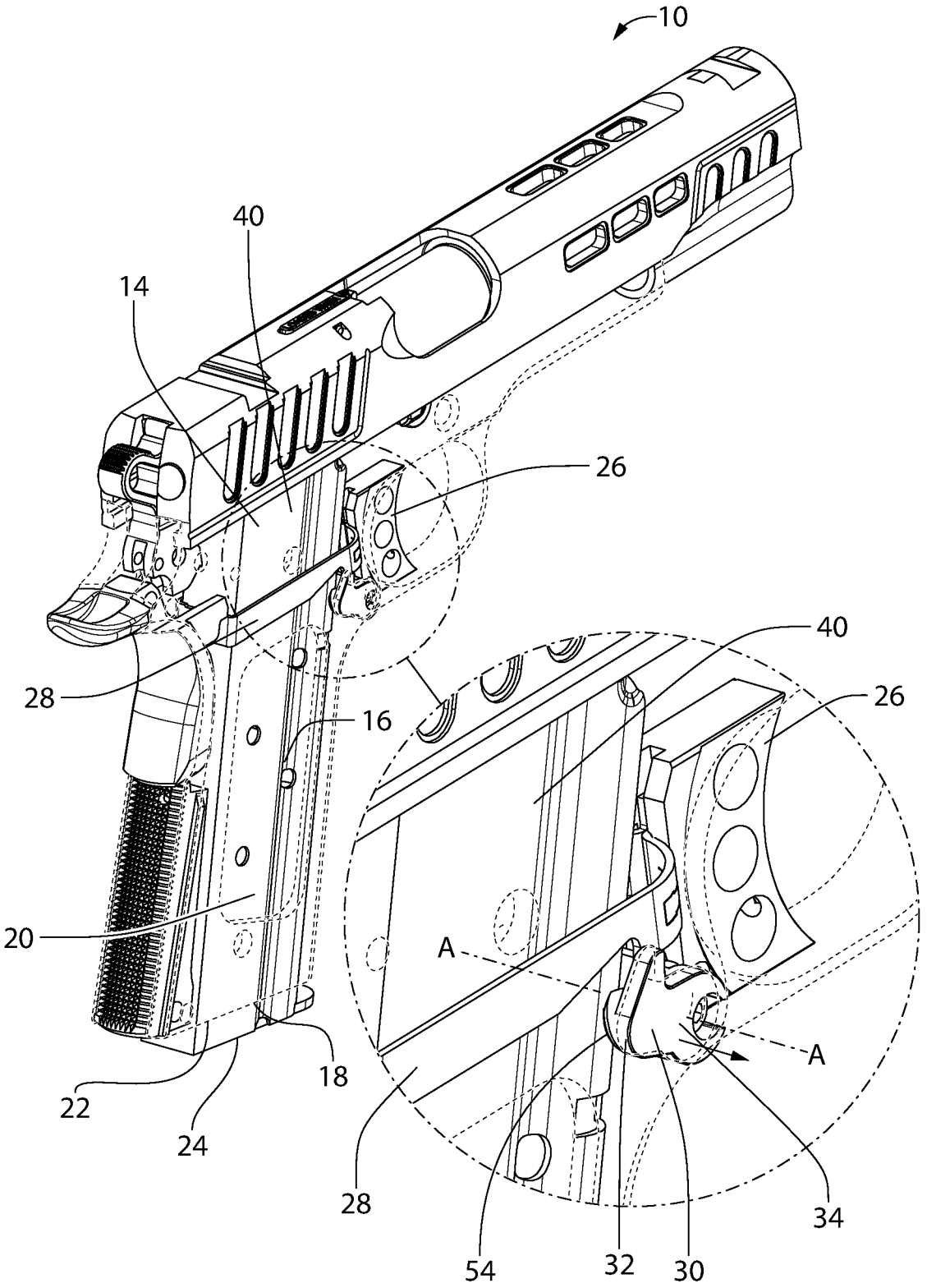
FIG. 6D is a right rear isometric view of the firearm having a magazine disconnect safety of FIG. 1, shown with an enlarged view of a trigger, trigger bar and magazine catch, shown with a magazine partially inserted in a magazine receptable of the frame of the firearm in further engagement with the magazine catch than that of FIG. 6C.
Figure 6E:
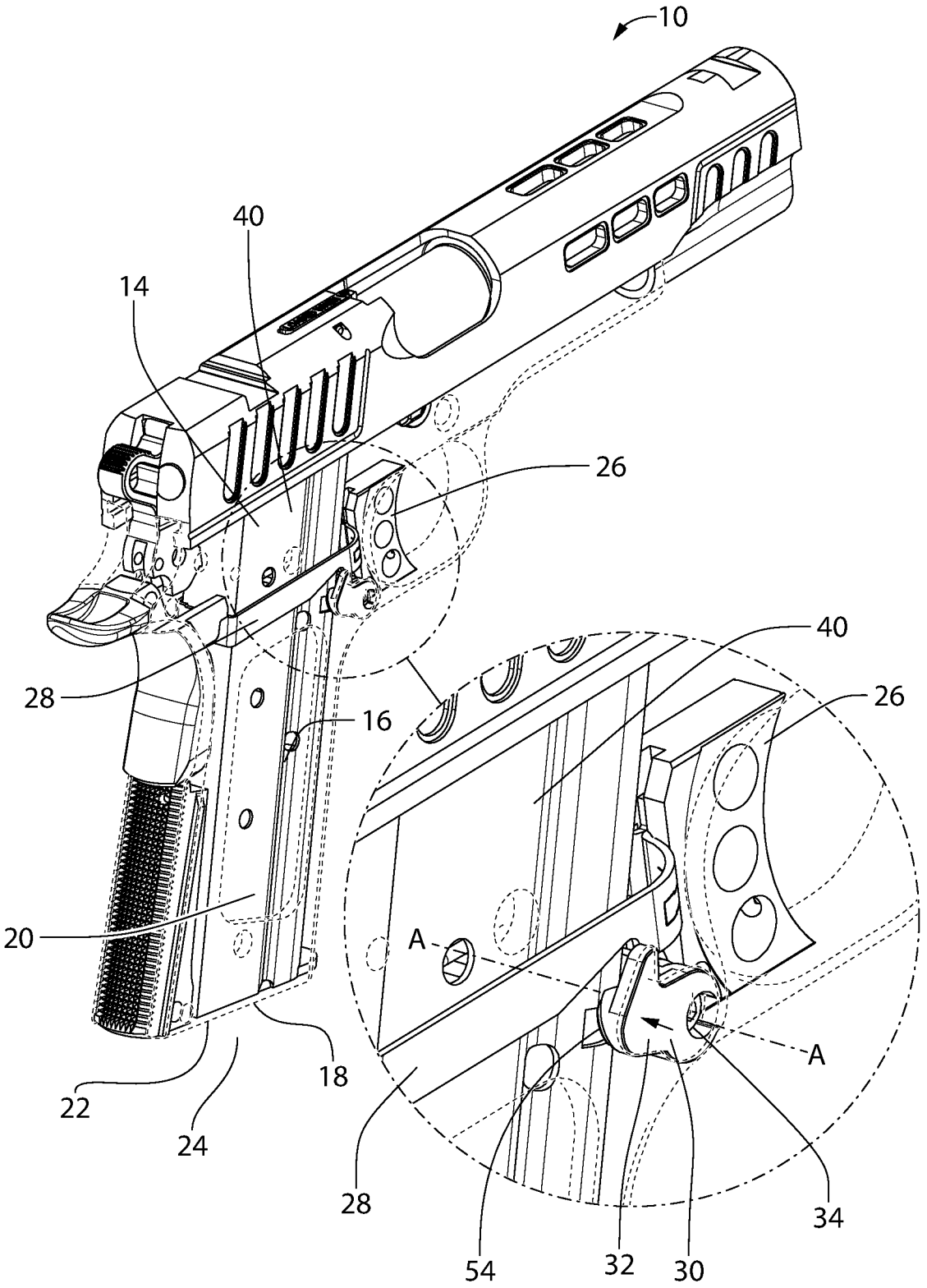
FIG. 6E is a right rear isometric view of the firearm having a magazine disconnect safety of FIG. 1, shown with an enlarged view of a trigger, trigger bar and magazine catch, shown with a magazine fully inserted in a magazine receptable of the frame of the firearm, with the trigger in an undepressed condition.
Figure 6F:
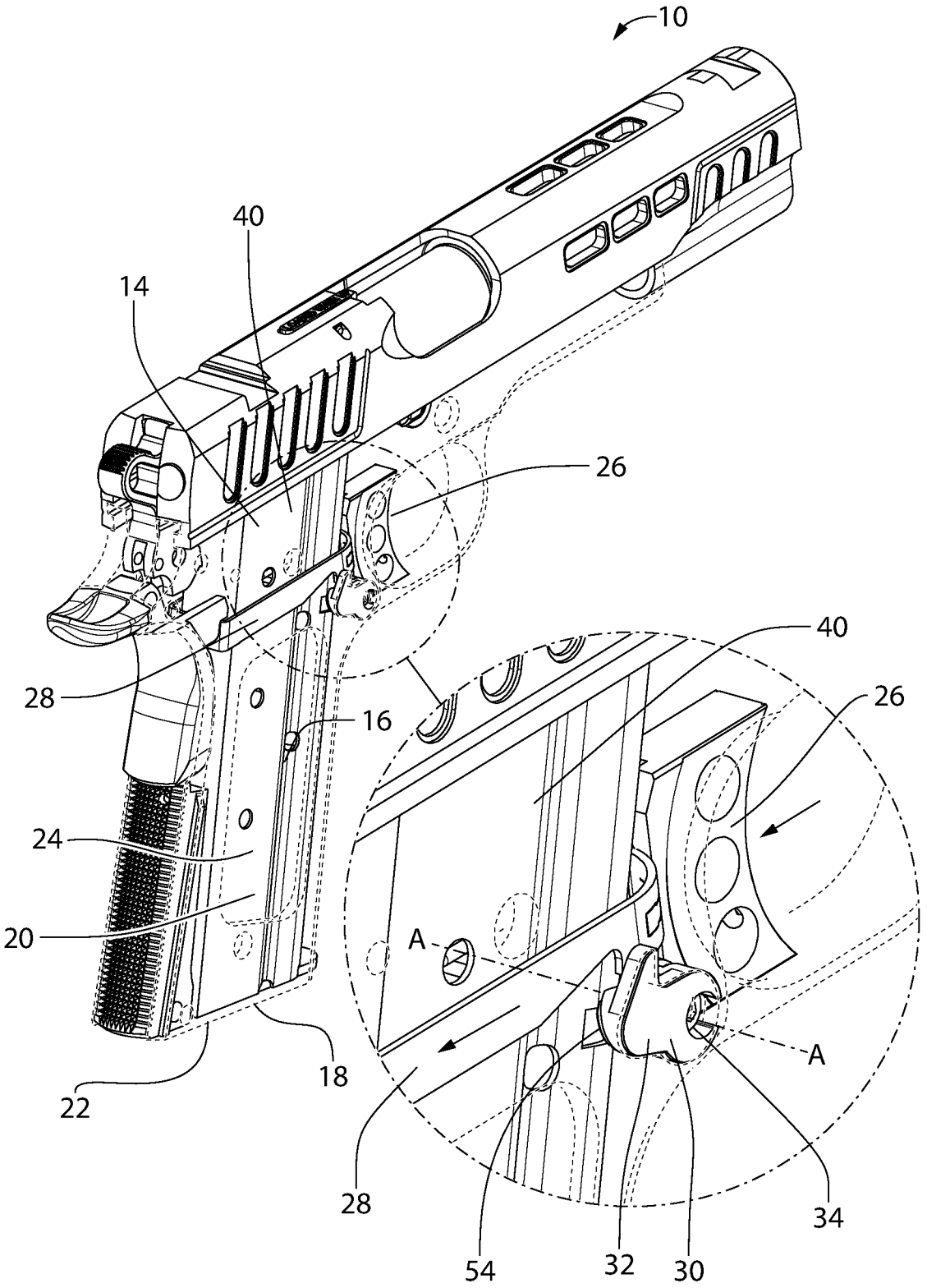
FIG. 6F is a right rear isometric view of the firearm having a magazine disconnect safety of FIG. 1, shown with an enlarged view of a trigger, trigger bar and magazine catch, shown with a magazine fully inserted in a magazine receptable of the frame of the firearm, with the trigger in a fully depressed condition.

The securement pin 34 of the magazine catch 30 has a first end 34A removably disposed and captured in an aperture 38B on a second side 46 of the frame 14 (e.g., by a keyed slot in the frame that mates with a tab on the first end 34A), and a second spring receiving end 34B. The spring 36 has a first end 36A disposed against the catch body 32 adjacent to the spring receiving end 44, and a second end 36B disposed against the second spring receiving end 34B of the securement pin 34. The catch body 32, the spring 36, and the securement pin 34 are all captured between the apertures 38A (see FIG. 3), 38B (see FIG. 2) on the first side of the frame 46 and the second side 50 of the frame 14, respectively. The catch body 32 is movable by a user depressing the actuating button end 42 of the catch body 32 along its longitudinal axis A within the frame 14 from a first position (see FIGS. 6E and 6F) wherein the magazine 24 is disposed and secured in the magazine receptable 16 of the frame 14 to a second position (see FIGS. 6A, 6B and 6C) wherein the magazine 24 is separatable from the frame 14.

Figure 5A:
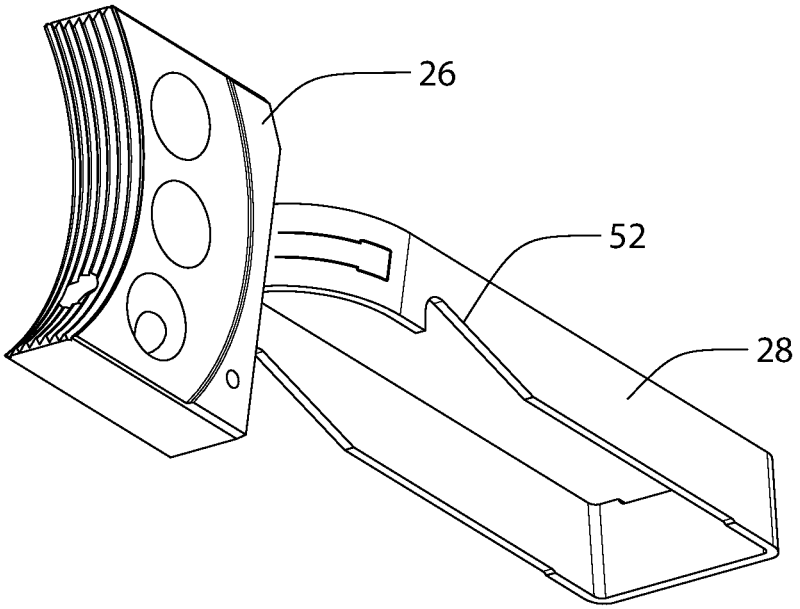
FIG. 5A is a front isometric view of a trigger and trigger bow assembly of the firearm having a magazine disconnect safety of FIG. 1.
Figure 5B:
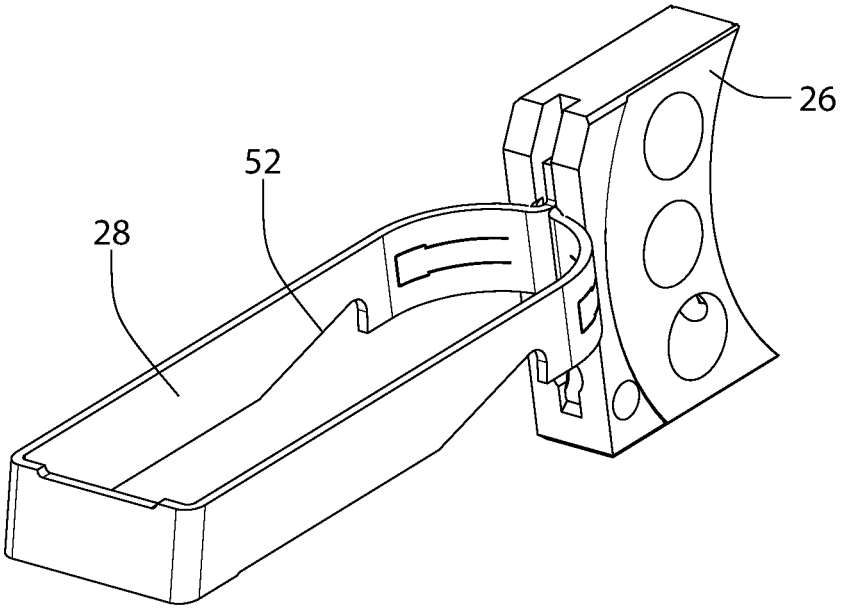
FIG. 5B is a rear isometric view of a trigger and trigger bow assembly of FIG. 5A.

As best seen in FIGS. 5A and 5B, the trigger bow 28 is disposed on the trigger 26 in the usual manner seen in 1911 style pistols. However, in accordance with the present invention, the trigger bow 28 has a notch 52 for receipt of the protuberance 48 of the catch body 32, providing for the safety feature of magazine safety disconnect 12. That is, when the catch body 32 is in the first position (see FIGS. 6A and 6B), the protuberance 48 engages the notch 52 to prevent movement of the trigger bow 28 (and therefore the trigger 26). When the catch body 32 is in the second position (see FIGS. 6D, 6E and 6F), the protuberance 48 of the catch body 32 does not engage the notch 52, providing for free movement of the trigger bow 28 (and therefore the trigger 26).

The catch body 32 includes a catch body cam surface 54 and the magazine 24 includes a magazine cam surface 56. As the magazine 24 is disposed in the magazine receptable 16 in the frame 14, the magazine cam surface 56 engages the catch body cam 54 surface to urge the catch body 32 from the second position to the first position. With the magazine 24 fully installed in the magazine receptacle 16, the catch body 32 remains in the first position. That is, the protuberance 48 of the catch body 32 moves out of engagement with the notch 52 in the trigger bow 28 in direction B, thereby allowing for movement of the trigger 26 and trigger bow 28.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A magazine catch safety, comprising a safety device to lock a trigger of a firearm when a magazine is removed from a magazine receptacle of a frame of the firearm, the magazine catch safety comprising:

(A) a catch body, comprising:

(i) a longitudinal axis, an actuating button end, and a spring receiving end, the catch body for receipt in a first side of the frame and disposed for longitudinal movement within the frame; and (ii) a protuberance disposed on the catch body;

(B) a securement pin having a first end for removable securement on a second side of the frame, and a second spring receiving end;

(C) a spring having a first end disposed against the catch body at the spring receiving end of the catch body, and a second end disposed against the second spring receiving end of the securement pin; and (D) a trigger bow, the trigger bow having a notch, wherein, when the catch body is in a first position, the protuberance is engaged in the notch to prevent movement of the trigger bow, and wherein when the catch body is in a second position, the protuberance of the catch body does not engage the notch, providing for free movement of the trigger bow.

2. The magazine catch safety of claim 1, wherein the catch body includes a catch body cam surface and the magazine includes a magazine cam surface, wherein when the magazine is disposed in the magazine receptable in the frame, the magazine cam surface engages the catch body cam surface to move the catch body from the second position to the first position.

3. A firearm having a magazine disconnect safety comprising:

(A) a frame having a magazine receptacle, the magazine receptacle comprising an open end and a hollow internal portion, the frame having an aperture adjacent to the magazine receptacle;

(B) a trigger, the trigger movable in a plane from an extended position to a depressed position, (C) a trigger bow disposed within the frame and disposed on the trigger (D) a magazine releasably disposed in the magazine receptacle, that is movable from a released position wherein the magazine is separated from the magazine receptacle to an installed position wherein the magazine is seated in the magazine receptacle; and (E) a magazine catch comprising a safety device to lock the trigger when the magazine is removed from the magazine receptacle, the magazine catch disposed in the frame adjacent an upper end of the magazine receptacle, the magazine catch comprising:

(i) a catch body, comprising:

(a) a longitudinal axis, an actuating button end, and a spring receiving end, the catch body captured in a first side of the frame and longitudinally movable within the frame;

(b) a protuberance disposed on the catch body;

(ii) a securement pin having a first end removably disposed on a second side of the frame, and a second spring receiving end; and (iii) a spring having a first end disposed against the catch body at the spring receiving end of the catch body, and a second end disposed against the second spring receiving end of the securement pin whereby the catch body is movable along its longitudinal axis within the frame from a first position wherein the magazine is disposed in the magazine receptable of the frame to a second position wherein the magazine is separated from the frame; and (F) a trigger bow disposed on the trigger, the trigger bow having a notch, wherein, when the catch body is in the first position, the protuberance is engaged in the notch to prevent movement of the trigger bow, and wherein when the catch body is in the second position, the protuberance of the catch body does not engage the notch, providing for free movement of the trigger bow.

4. The firearm of claim 3, wherein the catch body includes a catch body cam surface and the magazine includes a magazine cam surface, wherein when the magazine is disposed in the magazine receptable in the frame, the magazine cam surface engages the catch body cam surface to move the catch body from the second position to the first position.

* * * * *